United States Patent [19]

Forrester

[11] 4,154,403

[45] May 15, 1979

[54] SPRAYGUN

[75] Inventor: Alan J. Forrester, Pennant Hills, Australia

[73] Assignee: Tricentrol Manufacturing Pty. Limited, Marrickville, Australia

[21] Appl. No.: 823,239

[22] Filed: Aug. 9, 1977

[30] Foreign Application Priority Data

Aug. 27, 1976 [AU] Australia ..... PC7168

[51] Int. Cl.[2] ..... F16K 39/04

[52] U.S. Cl. ..... 239/528; 239/72; 137/630

[58] Field of Search ..... 239/72, 415, 527, 528, 239/583; 137/110, 553, 630, 630.14, 630.15, 614.11, 614.13, 614.14

[56] References Cited

U.S. PATENT DOCUMENTS 3,709,259 1/1973 Hechler ..... 137/630.15

FOREIGN PATENT DOCUMENTS 454716 10/1936 United Kingdom ..... 239/583

435002 11/1974 U.S.S.R. ..... 239/72

*Primary Examiner*—Robert W. Saifer

*Attorney, Agent, or Firm*—Ladas, Parry, Von Gehr, Goldsmith & Deschamps

[57] ABSTRACT

A spray gun having a main air valve to regulate the flow of pressured air to the galleries of the gun, and bleed means to bleed air from the high pressure side of the valve to the low pressure side to reduce the effort required by an operator to use the gun.

10 Claims, 3 Drawing Figures

SPRAYGUN

Figure 1:
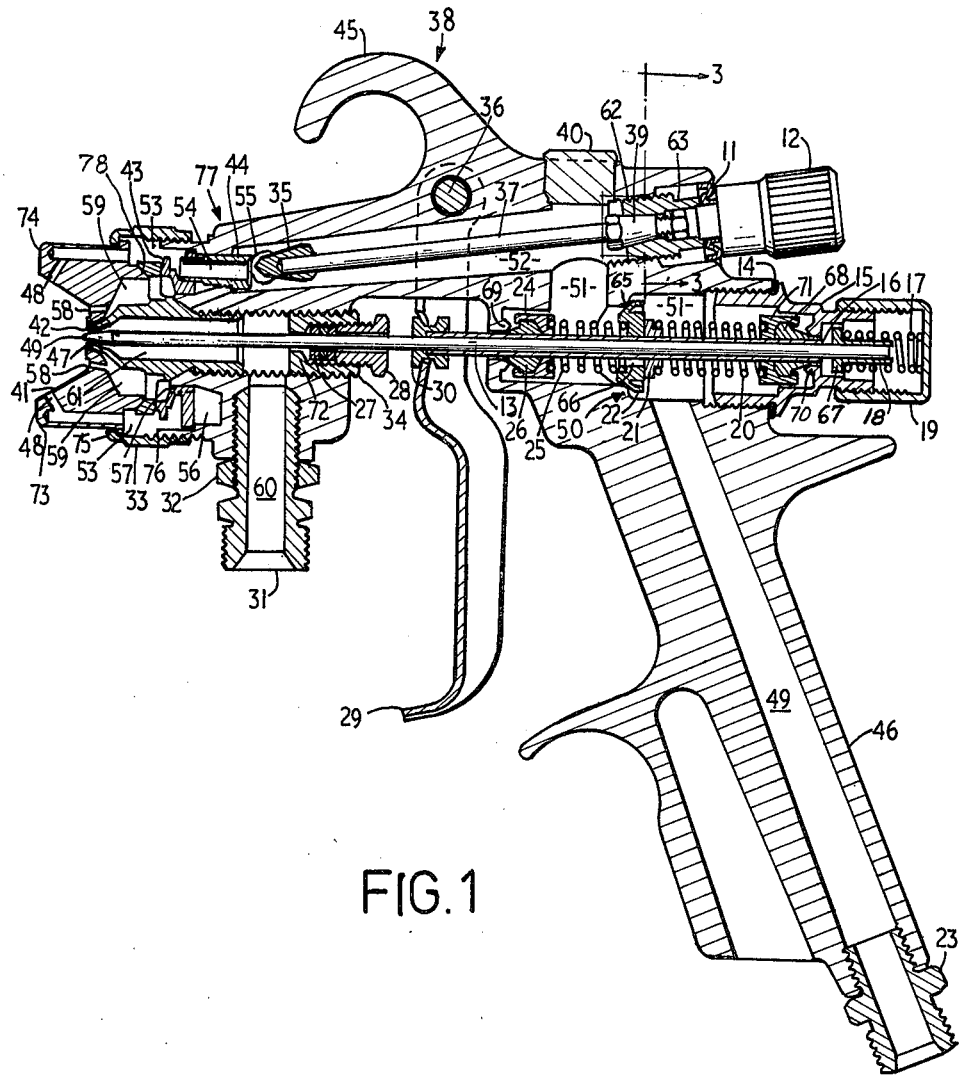

The present invention relates to spray guns and more particularly but not exclusively to improvements in the main air valve of a spray gun.

The resistance to the passage of air through the galleries within a spray gun and the turbulence of the air flow has a direct influence on the spray painting performance of the gun. Consequently in manufacturing an air spray gun it is a requirement that the air galleries offer minimum resistance and that turbulence within the gun is maintained at a minimum.

In efforts to meet the above requirements the galleries are enlarged except in the vicinity of the main air valve.

Since in the past the cross-sectional area of the valve has been restricted in order to keep the effort to be applied to the trigger within limits. This difficulty is obvious when it is considered that the load on the valve is proportional to the diameter of the valve squared. Consequently in known spray guns air flow through the main air valve is considerably restricted.

Also in the past the fan air control, which operates the fan air valve controlling the spray pattern produced by the gun, was threadably located in the body of the gun with the disadvantage that if the fan air valve was fully open and the control inadvertently rotated beyond that position then the fan air valve and spindle would be ejected from the gun without any warning due to the air pressure in the gun. In efforts to overcome this, the spindle was retained permanently within the gun, but this has the disadvantage that it is difficult to carry out repairs on the fan air control and its associated air seals, since this requires the removal of the spindle.

It is also desired to minimise manufacturing cost by having the paint flow control co-axial with the main air valve control. This obviates unnecessary machining of the gun's cast body.

The object of the present invention is to provide a spray gun ameliorating the above disadvantages.

Accordingly the present invention in a first general form is a spray gun having a body with air galleries with regulating means to regulate the flow of air from a source of pressurised air to the air galleries, said regulating means comprising a valve with a valve seat, a movable valve member shaped to co-operate with said seat to close the passage defined by said seat, and bleed means operable to bleed air from the high pressure side of said valve to the low pressure side to thereby reduce the effort required to move said valve member from a seated position to a position allowing air to flow through said passage.

The present invention in accordance with the above general form allows larger valves to be used in spray guns by decreasing the load on the trigger of the gun. This is achieved by reducing the pressure difference between the two sides of the movable valve member, more particularly by bleeding air from the high pressure side to the low pressure side of the valve member. Thus the remaining effort required to move the valve is minimised.

In a second general form the present invention is a spray gun comprising a body, air galleries with regulating means to regulate the flow of air from a source of pressurised air to the air galleries, an air nozzle communicating with said galleries and having side ports through which air is ejected to adjust the spray pattern produced by the gun, and adjustment means to adjust the rate of flow of air passing through said side ports, said adjustment means including a passage extending from the exterior of said body toward said nozzle and terminating at its inner end with a valve, said passage being in communication with said galleries and supplying air to said side ports via said valve, said valve including a valve seat and a movable valve member to define an adjustable valve opening to regulate the flow of air passing therethrough, a spindle attached at one end to said valve member and extending through said passage and projecting outwardly from said body, said spindle having a threaded portion engaging said body so that rotation of said spindle about its longitudinal axis causes said valve member to move toward or away from said seat to thereby vary the size of the valve opening, seal means attached to said spindle and engaging said body to sealingly close the other end of said passage, said threaded portion being provided with duct means so that air may pass between said body and said threaded portion, and wherein said threaded portion and seal means are so located that said seal means may be positioned outside said body by the rotation of said spindle while said threaded portion is still engaged with said body.

In accordance with the above second general form of the present invention, the spray gun is provided with a warning means whereby the operator of the gun is warned that the spindle is not to be rotated further if it is not to be withdrawn from the gun. The warning is an audible warning given by the air leaving the gun through the duct. The air is allowed to escape by the seal being located beyond the body while the spindle is still retained within the body by the threaded portion.

Figure 2:
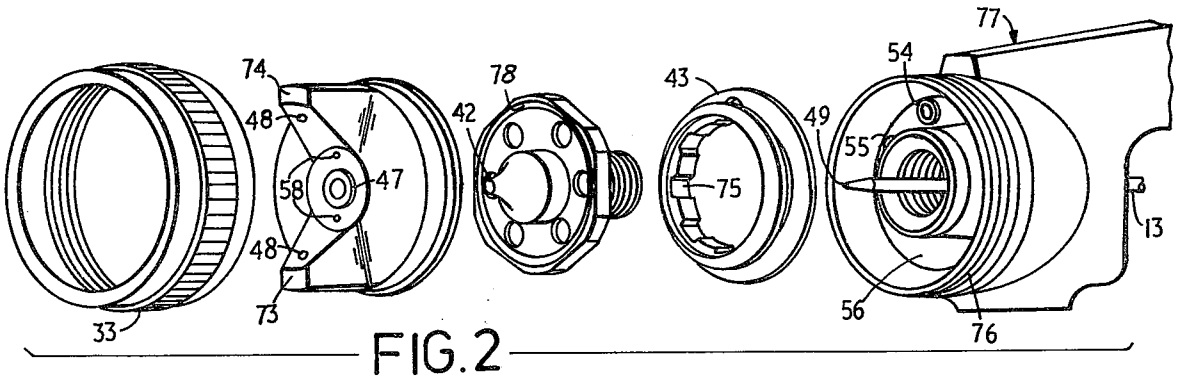
Figure 3:
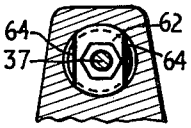

A preferred form of the present invention will now be described by way of example with reference to the accompanying drawings wherein:

FIG. 1 is a sectioned side elevation depicting the spray gun embodying the features of the present invention, FIG. 2 is an exploded view of the front of the gun of FIG. 1, and FIG. 3 is a sectional view taken on the line 3—3 of FIG. 1.

The spray gun of this embodiment has a body 38 provided with a handle 46 having an air inlet 23 adapted to be attached to a supply of pressurised air. Pivotally attached to the body by pivot 36 is the trigger 29 which upon movement thereof, allows air to be ejected from annular orifice 47, containment nozzles 58, and side ports 48, while paint is siphoned through fluid supply orifice 49. Air in passing from the inlet 23 to the air cap 41, containing the orifice 47 and side ports 48, is ducted through the air galleries of the gun including inlet passage 49 leading to the chamber 51 containing the main air valve 50, and outlet passage 52 extending from the air valve 50. At the end of passage 52 the air stream is split into two branches, the first branch passing through valve 77 which regulates the amount of air which is to pass through the side ports 48 of the nozzle cap 41 via passage 54 and annular chamber 53 defined in part by the air diffuser 43. The primary purpose of the side ports 48 is to shape the rounded cross-section of the fluid stream into an elliptical shape which is generally referred to as "fan" shaped. Additional turbulence also occurs at the intersections of the air streams which results in further atomization of the fluid. The second branch is ducted through passages 55, of which only one is depicted in FIG. 1. The passage 55 delivers air to the annular chamber 56 wherefrom the air is directed through slots 57, formed in air diffuser 43, to a further annular chamber 59. Air is then ejected from the chamber 59 through the annular orifice 47 and forms a cylindrical air stream which siphons fluid through the fluid nozzle 49 by creating a vacuum in a fluid container attached to the material supply nipple 31 held in position by lock nut 32. Under the influence of atmospheric pressure the fluid is forced up through passages 60 and 61 to the fluid supply orifice 49. This cylindrical air stream forms an envelope of pressurised air surrounding the fluid sprayed from the fluid supply orifice 49. The resulting turbulence mixes or coarsely atomizes the fluid with the air. Air is also ejected from the containment nozzles 58 which also receives its air from chamber 59. The containment nozzles keep the air and fluid stream from spreading.

The rate of flow of air passing through the air diffuser is adjusted by moving the movable valve member 35 relative to the air diffuser tube 44. This adjustment is affected by the rotation of the fan control knob 12 which is threadably attached to the body 38 of the gun at portion 62. A spindle 37 extends between the knob 12 and the movable valve member 35. To sealingly close the passage 52 a seal 11 is provided between the spindle 37 and the body 38. For ease of assembly and maintenance the spindle 37, seal 11 and knob 12 are removable as an assembly which under normal conditions has a disadvantage in that if the knob 12 is rotated sufficiently the entire assembly may be ejected from the gun due to the air pressure within the passage 52. To ameliorate this disadvantage the threaded portion 62 of the spindle 37 has flats 64 ground thereon and is of a sufficient length that if the knob is rotated further than is required the seal 11 becomes located outside the passage 52 and air is allowed to flow past the threaded portion 62 via flats 64 so that the operator receives an audible warning that if the knob is rotated further the assembly will be ejected. The warning is the sound of the air rushing past the threaded portion and leaving the gun at the open end of passage 52.

The main air valve 50 of the gun has a valve seat 65 and movable valve member 22 shaped to co-operate therewith. The movable valve member 22 is formed with a passage 66 sealingly closed off, when not in operation, by the second movable valve member 21 which is biased toward member 22 by spring 20. The member 21 is fixed to the hollow shaft 16 which is axially movable by trigger 29.

The passage 51 within which the main air valve 50 is housed is sealed off, apart from the air inlet passage 49 and outlet passage 52, by seals 26 and 68 forced into engagement with their respective seats 69 and 70 by springs 25 and 20.

The main air valve 50 is operated by movement of the trigger 29 to the right which in turn causes a corresponding movement in the hollow shaft 16 and member 21 to compress spring 20. Air then flows through passage 66 to decrease the pressure difference across the member 22. As the air pressure difference decreases spring 25 moves member 22 from its seated position (illustrated) to thereby open the passage surrounded by seat 65. In this manner the effort required by an operator to activate the main air control valve 50 is the effort to move the smaller member 21, whereupon the larger member 22 is then moved without any further effort being required from the operator. Consequently the effort needed to operate the main air valve of a conventional spray gun is now employed to operate a much larger valve.

The seals 26 and 68 slidably engage the shaft 16 and are supported by seal buckets 24 and 71 upon which the springs 25 and 20 directly act. The seal 22 also slidably engages the shaft 16. In the depicted position the main air valve 50 is closed and will remain in that position due to spring 20, however upon movement of the trigger beyond a predetermined position, wherein the member 21 is moved from its seat, the member 22 is moved from its seated position by spring 25. The shaft 16 is directly acted upon by cap 30 which is moved by trigger 29.

Co-axial with and slidable through the hollow shaft 16 is the material supply needle 13 which engages the material supply nozzle 42 to close the fluid supply orifice 49. Movement of the needle 13 to the right opens the material supply orifice 49 to allow paint to be siphoned therethrough. The right-hand end of the needle 13 has a cap 18 fixed thereto, which cap 18 has a flange 67 which is engaged by the right-hand end of the shaft 16 to move the needle 13. The flange 67 is also engaged by the spring 17 to bias the needle 13 to a closed position as depicted. As shown there is a clearance between the right-hand end of shaft 16 and the flange 67 which enable the main air valve 50 to be opened without the fluid supply orifice 49 being opened, thus the gun may be used as an air gun to remove dust from objects prior to the application of paint thereto. The material supply needle adjustment cap 19, upon which the spring 17 bears, is used to define the position of maximum movement of the needle 16 and thus the size of the orifice 49.

The passage 61 is closed at its right-hand end by the gland packing 27 forced into engagement with the seat 72 by the gland nut 28.

The described embodiment of the present invention provides a system of continuous seal adjustment by way of the two springs 25 and 20 applying pressure to the seal 26 and 28. This seal arrangement provides a superior seal arrangement when compared to conventional spray guns wherein the seal of the valve spindle is effected by a threaded closure member.

Turning again to the front of the gun wherein the air cap 41, provided with lugs 73 and 74, is attached to the body 38 of the gun by the retaining ring 33 which has a lip 75 which engages the air cap 41 and a threaded portion 76 which engages the body 38. The air cap 41 has a tapered surface 78 which sealingly engages a corresponding surface on the material nozzle 42. The material nozzle 42 is threadably located in the body 38 and sealingly engages the air diffuser 43 to also press it into sealing engagement with the body 38.

The body 38 of the gun is provided with a hook 45 to enable the gun to be hung up when not in use.

It should be appreciated that the present invention, although described as a paint spray gun, is just as applicable to any spray gun wherein a fluid is atomised and ejected from a gun employing pressured air. It should further be appreciated that the invention is not restricted to a siphon fluid feed as it is just as applicable to a pressure feed wherein the fluid reservoir is pressurised to supply fluid to the material supply nozzle.

What I claim is:

1. A spray gun having a body with air galleries; regulating means to regulate the flow of air from a source of pressurized air to the air galleries; a trigger with a shaft to operate said regulating means; said regulating means comprising a valve seat, a first movable valve member slidably mounted on said shaft and shaped so as to co-operate with said seat to close the passage defined thereby, a passage extending through said movable valve member to bleed air from the high pressure side to the low pressure side thereof, a second movable valve member mounted on said shaft so as to be movable thereby, said second valve member being adapted to selectively engage said first movable valve member to sealingly close the passage extending therethrough, a first spring biasing said second movable valve member toward said seat to engage said first movable valve member, a second spring biasing said first movable valve member to an open position, wherein said first spring applies sufficient force to said second movable valve member to hold said first movable valve member in a closed position with respect to said seat until said second movable valve member is moved away from said first movable valve member to expose the passage therethrough to allow said first movable valve member to move to an open position with respect to said seat under the influence of said second spring.

2. A spray gun according to claim 1, wherein said body has an air duct extending therethrough within which said regulating means is located so that said shaft extends through said duct, and said gun further comprises seal means at each end of said duct sealingly engaging said shaft and body to close the ends of said duct, an air inlet to said duct, an air outlet from said duct spaced from said air inlet, said valve seat of said regulating means being located between said air inlet and outlet so that the movable valve members when seated block communication between said air inlet and air outlet.

3. A spray gun according to claim 2, wherein said first spring bears against one of said seal means to force it into engagement with said body, and said second spring bears against the other of said seal means to force it into engagement with said body.

4. A spray gun according to claim 3, wherein said gun further comprises a fluid supply nozzle, a fluid supply regulating needle to selectively close said nozzle, and wherein said shaft is hollow and said needle slidingly extends through said shaft, said trigger is located between said nozzle and said regulating means and is pivotally attached to said body to cause movement of said shaft upon being pivotally moved away from said nozzle so as to provide communication between said air inlet and air outlet, said needle has a flanged end remote from said nozzle which end is engaged by an end of said shaft to move said needle so as to open said nozzle upon movement of said shaft beyond a predetermined position.

5. A spray gun according to claim 4, wherein said flanged end is engaged by a third spring which biases said needle to close said nozzle.

6. A spray gun according to claim 1, wherein said spray gun further comprises an air nozzle communicating with said galleries and having side ports through which air is ejected to adjust the spray pattern produced by the gun, and adjustment means to adjust the rate of flow of air passing through said side ports, said adjustment means including a further passage extending from the exterior of said body toward said nozzle and terminating at its inner end with a valve, said further passage being in communication with said galleries and supplying air to said side ports via said valve, said valve including a valve seat and a movable valve member to co-operate with said seat to define an adjustable valve opening to regulate the flow of air passing therethrough, a spindle attached at one end to the movable valve member of said adjustment means and extending through said further passage and projecting outwardly from said body, said spindle having a threaded portion engaging said body so that rotation of said spindle about its longitudinal axis causes the movable valve member of said adjustment means to move toward or away from the seat of said adjustment means to thereby vary the size of the valve opening, further seal means attached to said spindle and engaging said body to sealingly close the outer end of said further passage, said threaded portion being provided with duct means so that air may pass between said body and said threaded portion, wherein said threaded portion and further seal means are so located that said further seal means is positionable outside said body by the rotation of said spindle while said threaded portion is still engaged with said body.

7. A spray gun according to claim 6, wherein said body has an air duct extending therethrough within which said regulating means is located so that said shaft extends through said duct, and said gun further comprises seal means at each end of said duct sealingly engaging said shaft and body to close the ends of said duct, an air inlet to said duct, an air outlet from said duct spaced from said air inlet, said valve seat of said regulating means being located between said air inlet and outlet so that the movable valve members when seated block communication between said air inlet and air outlet.

8. A spray gun according to claim 7, wherein said first spring bears against one of said seal means to force it into engagement with said body, and said second spring bears against the other of said seal means to force it into engagement with said body.

9. A spray gun according to claim 8, wherein said gun further comprises a fluid supply nozzle, a fluid supply regulating needle to selectively close said nozzle, and wherein said shaft is hollow and said needle slidingly extends through said shaft, said trigger is located between said nozzle and said regulating means and is pivotally attached to said body to cause movement of said shaft upon being pivotally moved away from said nozzle so as to provide communication between said air inlet and air outlet, said needle has a flanged end remote from said nozzle which end is engaged by an end of said shaft to move said needle so as to open said nozzle upon movement of said shaft beyond a predetermined position.

10. A spray gun according to claim 9, wherein said flanged end is engaged by a third spring which biases said needle to close said nozzle.

* * * * *